US007723646B2

(12) United States Patent
Lam

(10) Patent No.: US 7,723,646 B2
(45) Date of Patent: May 25, 2010

(54) FOLDABLE CLOTHES WARMER

(75) Inventor: Wing Yiu Lam, Shatin (HK)

(73) Assignee: Sincere International Trading Co. Ltd., Hong Kong SAR (CN)

( * ) Notice: Subject to any disclaimer, the term of this patent is extended or adjusted under 35 U.S.C. 154(b) by 626 days.

(21) Appl. No.: 11/716,025

(22) Filed: Mar. 9, 2007

(65) Prior Publication Data

US 2008/0053939 A1 Mar. 6, 2008

(30) Foreign Application Priority Data

Sep. 1, 2006 (HK) ..... 06109778.3

(51) Int. Cl.
*H05B 1/00* (2006.01)

(52) U.S. Cl. ..... 219/217; 219/385; 219/520; 219/521; 211/123; 211/26; 211/85; 211/85.3

(58) Field of Classification Search ..... 219/217, 219/385, 520, 521; 211/123, 26, 85, 85.3
See application file for complete search history.

(56) References Cited

U.S. PATENT DOCUMENTS

| | | | | | |
|---|---|---|---|---|---|
| 1,893,096 | A * | 1/1933 | Michaud | 211/172 |
| 2,494,861 | A * | 1/1950 | Chapman | 219/524 |
| 2,567,434 | A * | 9/1951 | Hoskings | 219/520 |
| 2,831,098 | A * | 4/1958 | Luscher | 219/385 |
| 3,160,482 | A * | 12/1964 | Foote | 34/665 |
| 4,559,442 | A * | 12/1985 | Graham | 219/385 |
| 4,724,969 | A * | 2/1988 | Steiner | 211/197 |
| 5,320,030 | A * | 6/1994 | Hubbard | 99/423 |
| 5,449,075 | A * | 9/1995 | Meade et al. | 211/197 |
| 5,566,838 | A * | 10/1996 | Tseng | 211/37 |
| 5,823,100 | A * | 10/1998 | Wienhold et al. | 99/449 |
| 6,497,331 | B1 * | 12/2002 | Morandi | 211/153 |
| D545,021 | S * | 6/2007 | Verbeek | D32/58 |
| D545,520 | S * | 6/2007 | Oberdorf | D32/58 |
| 7,389,887 | B2 * | 6/2008 | Liang | 211/149 |
| 7,461,752 | B2 * | 12/2008 | Li | 211/194 |
| D599,600 | S * | 9/2009 | Lam | D6/548 |
| 2003/0227753 | A1 | 12/2003 | Wrycraft | 361/727 |
| 2004/0090159 | A1 | 5/2004 | Tsutsumi et al. | 312/330 |
| 2007/0205173 | A1 * | 9/2007 | Garman et al. | 211/188 |
| 2008/0222909 | A1 * | 9/2008 | Picozza et al. | 34/195 |

FOREIGN PATENT DOCUMENTS

| | | |
|---|---|---|
| EP | 0837175 A1 | 4/1998 |
| FR | 2763611 | 11/1998 |
| GB | 732022 | 6/1955 |
| GB | 2250498 A | 8/1992 |

* cited by examiner

*Primary Examiner*—Tu B Hoang
*Assistant Examiner*—Vinod D Patel
(74) *Attorney, Agent, or Firm*—Jacobson Holman PLLC

(57) ABSTRACT

A joint device for providing hinged movement between a first and second arm member and for providing independent delivery of electrical power to the arm members, wherein said device includes a central portion for receiving at least two sets of electrical conductors and for delivering said at least one set of electrical conductors to each of said arm members, characterised in that upon hinged movement of the arm members about the central portion, the central portion maintains the conductors in a spaced apart relationship in a manner such that the structural integrity of said conductors is maintained for a predetermined minimum number of hinged movement cycles of said arm members.

13 Claims, 9 Drawing Sheets

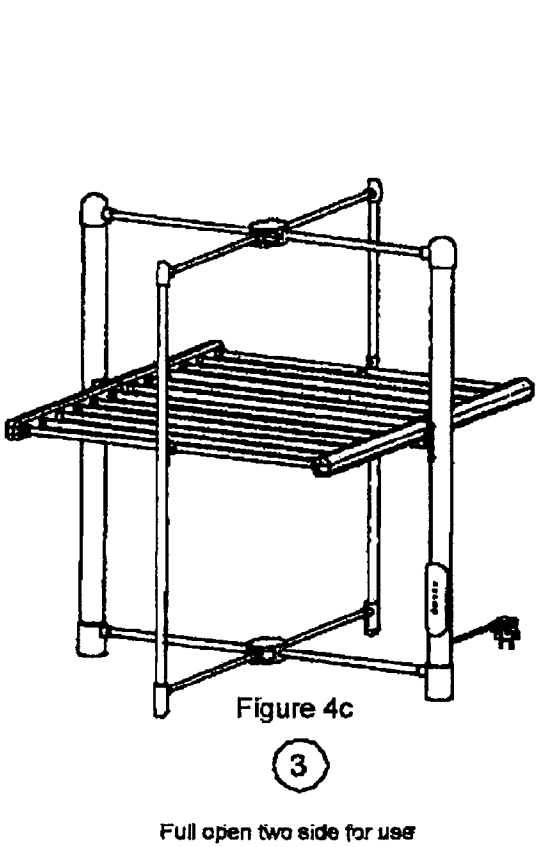
Figure 4a
1
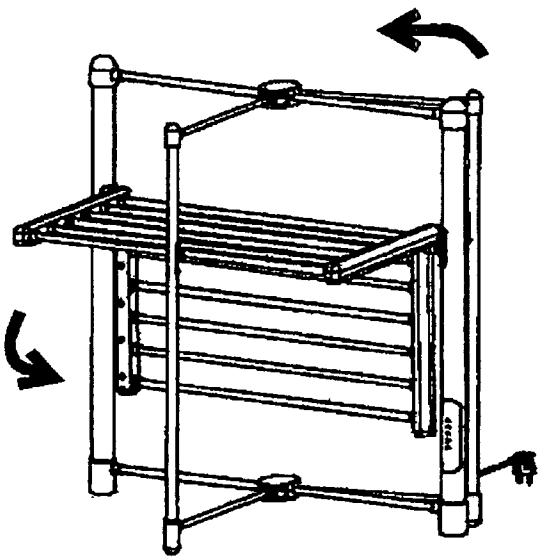
Figure 4b
2
Open single warmer to use
Figure 4c
3
Full open two side for use
FOLDABLE TOWEL & CLOTHES WARMER
You can open single layer warmer for use or full open with electronic control

FOLDABLE CLOTHES WARMER

FIELD OF THE INVENTION

The present invention relates to the field of clothes warmers for warming clothes. More particularly, the present invention relates to a collapsible clothes warmer for warming clothes.

BACKGROUND OF THE INVENTION

Stands or racks for the heating or warming of clothes, for example, towels or other bathroom apparel, are often used to preheat or warm such clothes prior to being worn or used by a user. Particularly, in countries having a relatively cold ambient temperatures during the winter months, particularly European in countries, the use of such racks is often used to also remove small amounts of moisture accumulated in clothes whilst providing a pre-heated clothing which mitigates the impact of temperature differential between the clothes and the user upon the user dressing in the clothes.

Such devices as those described above are typically powered by mains power and heating elements are placed at or adjacent rack-liked portions which hold the clothes, the heating elements applying heatable warmth to the clothes either via convection or conduction, thus imparting warmth to the clothes. Due to the relatively close exposure of the heating elements to a user, such devices should comply with CE marking and GS mark, in particular when used in European countries. With the exception of some higher risk products, most products can be self-declared to meet the essential requirements by a manufacturer. While the use of a CE marking permits a product's access to the European Union, it is not an approval certification, and a CE marking is only a declaration of the supplier's own responsibility. Thus, while allowing products to be placed on the European market, such marking allows for the free movement of goods and permits the withdrawal of non-conforming or offending products.

It is an object of the present invention to provide a clothes warmer which overcomes or substantially alleviates at least some of the deficiencies exhibited by those of the prior art.

SUMMARY OF THE INVENTION

In a broad general aspect, the present invention provides a joint device for providing hinged movement between a first and second arm member for providing independent delivery of electrical power to the arm members, wherein said device includes a central portion for receiving at least two sets of electrical conductors and delivering at least one set of electrical conductors to each of said arm members characterised in that upon hinged movement of the arm members about the central portion, the central portion maintains the conductors in a spaced apart relationship in a manner such that the structural integrity of said conductors is maintained for a predetermined minimum number of hinged movement cycles of said arm members.

The predetermined number of hinged movement cycles is preferably that of which to satisfy regulatory approval standards for electrical components. Preferably, the central portion is adapted to provide a pivot axis and said electrical conductors are received axially by the central portion and are distributed radially outwardly to each of said arm members. The electrical conductors are preferably received in an axial bore within said central portion and said central portion includes a web portion for maintaining the electrical conductors spaced apart from each other.

In a first aspect, the present invention provides a joint device for providing hinged movement between a first and second arm member for providing independent delivery of electrical power to the arm members, said device comprising a first boss member having a passage extending there through, said first boss member being fixed relative to a first arm member; a second boss member having a passage extending there through, the passage of the first boss member being coaxially aligned with that of the second boss member, said second boss member being fixed relative to the second arm member; a central pivot member including a spigot portion adapted to extend at least partly through the central passages of the boss members to allow relative hinged movement between the first arm member and the second arm member; a central passage for receiving a first electrical conductor for delivery of electrical power to the first arm member a second electrical conductor for delivery of electrical power to the second arm member; and a separation portion for maintaining the first electrical conductor and the second electrical conductor in a spaced apart relationship upon relative hinged movement between the first arm member and the second arm member.

In a second aspect, the present invention provides a foldable frame for warming of clothes, said frame comprising a first arm assembly including a pair generally elongate first arm members being maintained in a parallel spaced apart relationship by a plurality of elongate clothes hanging members extending there between; a second arm assembly including a pair generally elongate second arm members being maintained in a parallel spaced apart relationship by a plurality of elongate clothes hanging members extending there between; a first joint device and a second joint device disposed between adjacent ends of the first and second arm members respectively in a manner so as to provide relative hinged movement between the first arm assembly and the second arm assembly; wherein at least one joint device comprises a first boss member having a passage extending there through, said first boss member being fixed relative to an adjacent first arm member; a second boss member having a passage extending there through, the passage of the first boss member being coaxially aligned with that of the second boss member, said second boss member being fixed relative to an adjacent second arm member; a central pivot member including a spigot portion adapted to extend at least partly through the central passages of the boss members to allow relative hinged movement between the first arm member and the second arm member; a central passage for receiving a first electrical conductor for delivery of electrical power to the first arm assembly via the adjacent first arm member for supplying power to a heating element associated with the elongate clothes hanging members, and for receiving a second electrical conductor for delivery of electrical power to the second arm assembly via the adjacent second arm member for supplying power to a heating element associated with the second arm member; and a separation portion for maintaining the first electrical conductor and the second electrical conductor in a spaced apart relationship upon relative hinged movement between the first arm member and the second arm member.

In an embodiment of the second aspect, the first arm assembly and the second arm assembly are preferably independently moveable relative to each other from a non-erect configuration whereby the arm assemblies extend from the joint devices in a downward direct to an erect configuration whereby the arm assemblies extend in generally horizontal plane.

In a third aspect, the present invention provides a foldable frame assembly for warming of clothes, said assembly comprising at least one foldable frame according to any of the above aspects and a support stand for supporting said at least one foldable frame at the first joint member and the second joint member to allow independent movement of the first arm assembly and the second arm assembly.

In an embodiment of the third aspect, the frame assembly preferably comprises a first pair of vertical support members each being disposed in a vertical orientation and engaged with the first and second joint members; an upper bracing member and a lower bracing member each extending generally horizontally above and below the at least one foldable frame respectively and between the first pair of vertical support members; a second pair of vertical support members each being disposed in a vertical orientation between the first pair of vertical support members and spaced apart so as to allow free relative hinged movement between the first arm assembly and the second arm assembly from a lowered position to an erect horizontal position; and upper and lower tie members extending from the upper and lower ends of the second pair of vertical support members and hingedly engaged with the upper and lower bracing members respectively so as to allow the second pair of vertical support members to be moved adjacent the first pair of vertical support members when the at least one foldable frame is a the lowered position.

Preferably the foldable frame assembly further comprising a detachably engageable engagement mechanism for engaging the first and second arm assemblies with the second pair of vertical support members.

In embodiments of the first, second and third aspects, the first electrical conductor and the second electrical conductor preferably extend through at least one of the support members first pair of vertical support members.

The central pivot member preferably further includes a mounting portion for engagement with a support stand. The central passage of the central pivot member preferably extends through the mounting portion.

The first boss member and the second boss member preferably have generally circular passages, and the spigot portion of central spigot member is generally circular in shape.

Preferably the first boss member and the second boss member each have radially disposed apertures therein for passage of the first and second electrical conductors to the first and second arm members respectively. The separating portion of the central pivot member is preferably provided as a web formation extending at least partly axially in the central passage.

The first boss member, the second boss member and the central pivot member are preferably formed from a material having electrical insulating properties. More preferably the first boss member, the second boss member and the central pivot member are formed from a polymeric material.

BRIEF DESCRIPTION OF THE DRAWINGS

The invention now will be described, by way of example only, and with reference to the accompanying drawings in which:

FIG. 3*f* shows an enlarged view of the joint device as depicted in FIG. 3*e* in a first configuration with a first electrical cable extending there through;

FIG. 4*a* shows an embodiment of a foldable frame assembly according to the present invention in a closed configuration;

FIG. 4*b* shows the foldable frame assembly as depicted in FIG. 4*a* in a partially assembled configuration;

FIG. 4*c* shows the foldable frame assembly of FIG. 4*a* and FIG. 4*b* in a fully assembled configuration;

DETAILED DESCRIPTION OF THE INVENTION

Figure 1A:
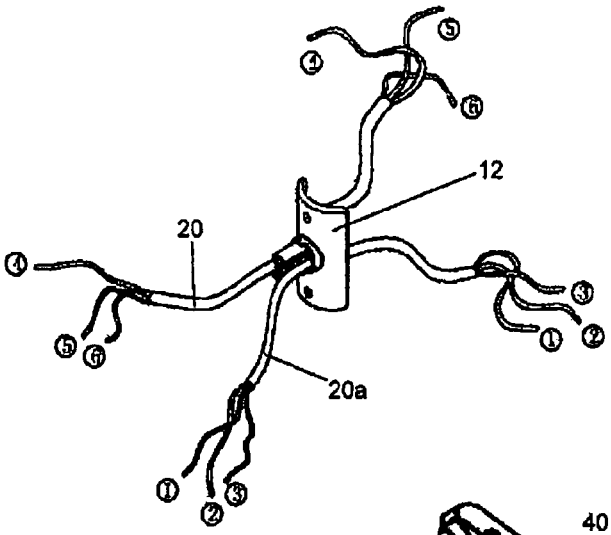
FIG. 1*a* shows a first perspective view of an embodiment of a central pivot member of the joint device according to the present invention.
Figure 1B:
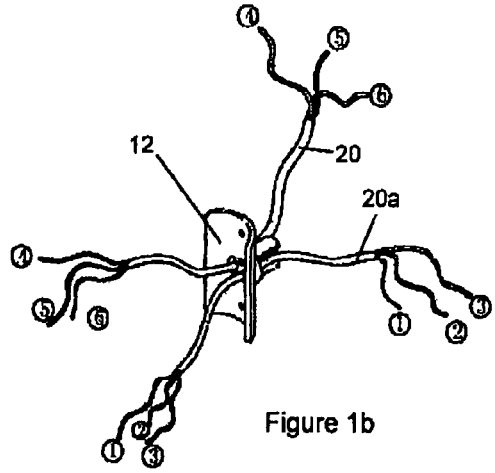
FIG. 1*b* shows a second perspective view of the central pivot member as depicted in FIG. 1*a;*
Figure 1C:
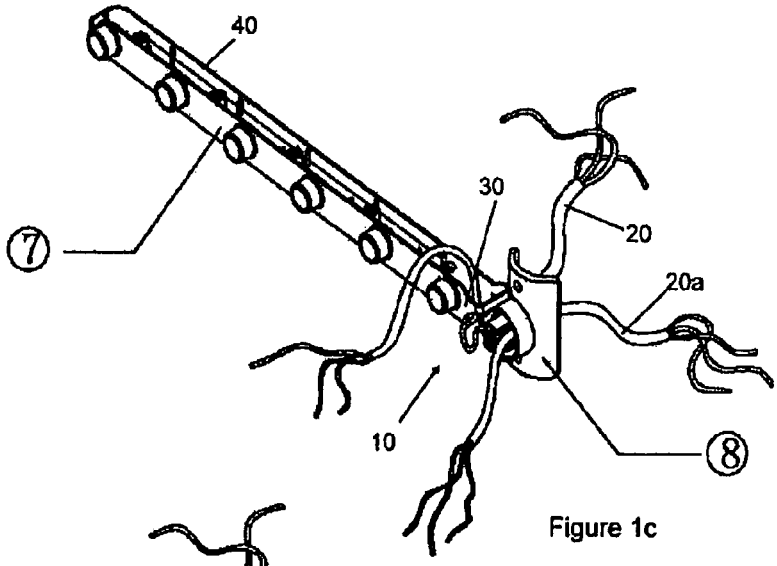
FIG. 1*c* shows a first boss member of the joint device according to the present invention into relief form with a first arm member engaged with the central pivot member as depicted in FIG. 1*a* and FIG. 1*b;*
Figure 1D:
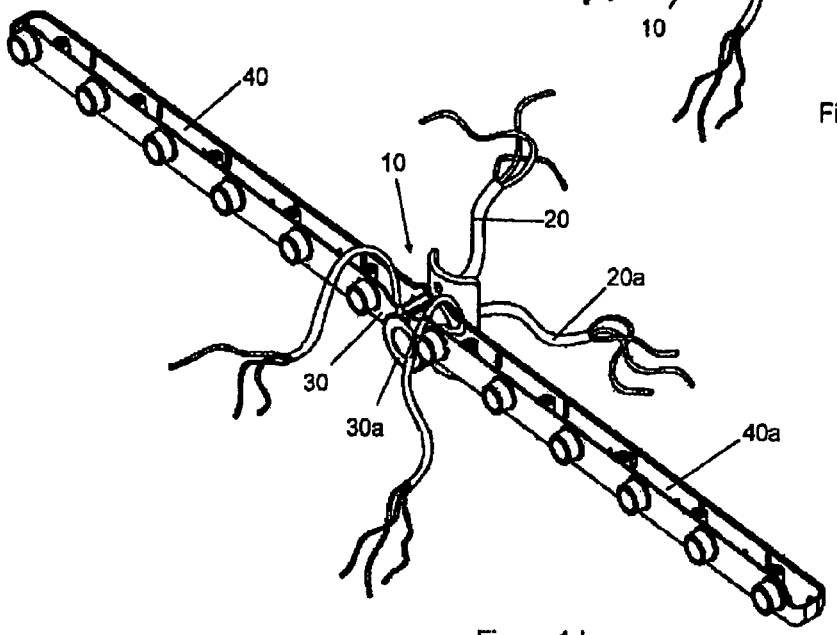
FIG. 1*d* shows a second boss member integrally formed with a second arm member and engaged with the first boss member and the central pivot member as depicted in FIG. 1*c;*

The following description refers to preferred embodiments of an analogue timepiece according to the present invention. To facilitate an understanding of the invention, reference is made in the description to the accompanying drawings whereby the adapter is illustrated in preferred embodiments. Similar components between the embodiments are identified by the same reference numerals.

Referring to FIGS. 1*a*, 1*b*, 1*c* and 1*d*, there is shown a joint device 10 for providing hinged movement between a first and a second arm member 40, 40*a* and providing independent delivery of electrical power to the arm members 40, 40*a* via electrical cables 20, 20*a*. The joint device 10 includes a first boss member 30, which is formed integrally with the first am member 40 in the present embodiment, and a second boss member 30*a*, again which is formed integrally in the present embodiment with the second arm member 40*a*. A central pivot member 12 is provided which includes a spigot portion 16 which is adapted to extend through passages of the bosses 30, 30*a* so as to provide a pin joint and allow hinged motion between arm member 40 and arm member 40*a*.

Figure 2A:
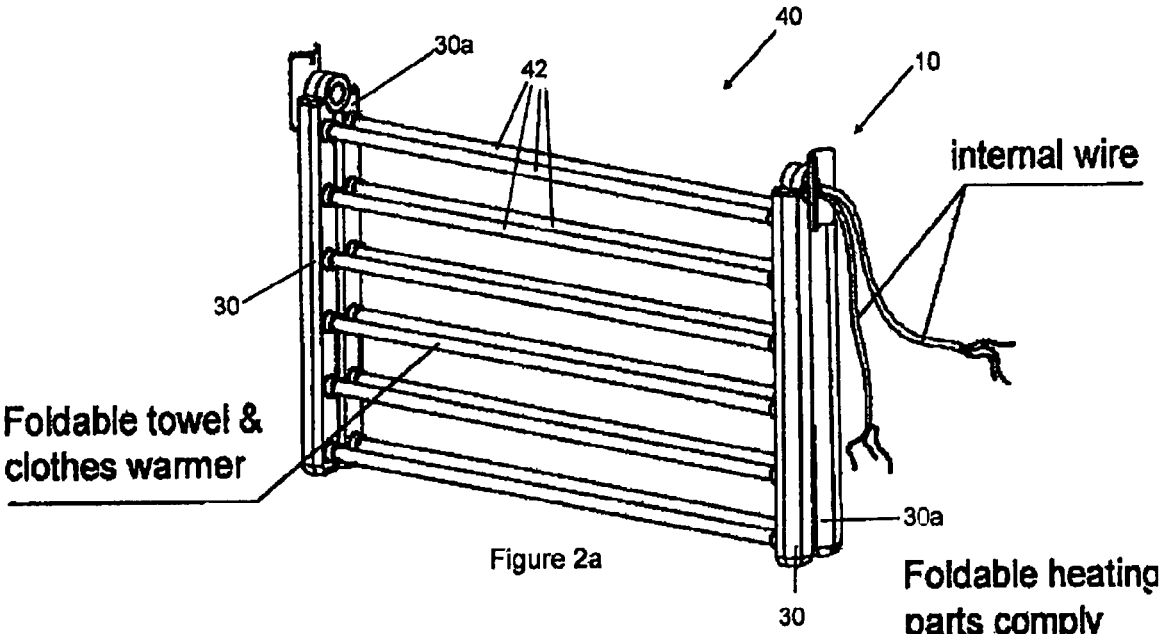
FIG. 2*a* shows a foldable frame according to the present invention in a fully folded configuration.
Figure 2B:
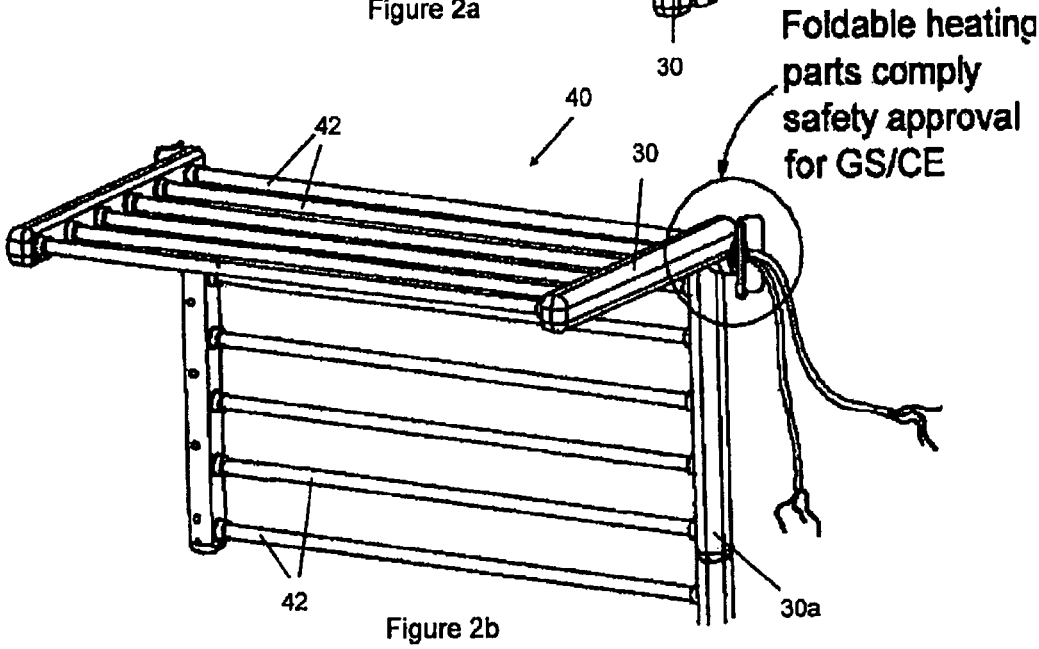
FIG. 2*b* shows the foldable frame as depicted in FIG. 2*a* in a part erect configuration.
Figure 2C:
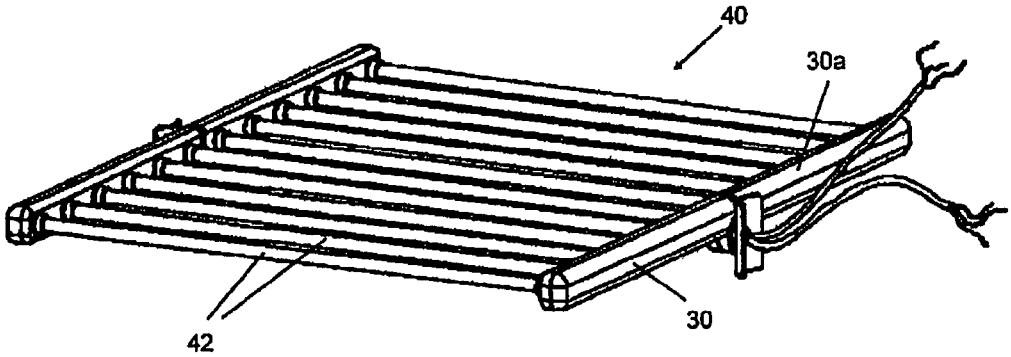
FIG. 2*c* shows the foldable frame as depicted in FIG. 2*a* and FIG. 2*b* in a fully erect state.

Referring FIGS. 2*a*, 2*b* and 2*c*, there is shown an embodiment of a foldable frame for warming clothes according to the present invention. The foldable frame 40 includes a first arm assembly which includes a pair of generally elongate first arm members being maintained in a parallel spaced part relationship by a plurality of elongate clothes hanging members 42 extending there between. A second arm assembly is also provided which also includes a pair of generally elongate second arm members 30*a* also being maintained in a parallel spaced part relationship by a plurality of clothes hanging members 42 extending there between. Between the first arm assembly and second arm assembly, a first joint device and a second joint device are disposed between adjacent ends of the first and second arm members 30, 30*a* respectively in a manner so as to provide a relatively hinged movement between the first arm assembly and the second arm assembly. In the present embodiment, one joint device is that as described with reference to FIGS. 1*a*-1*d* according to the present invention for providing electrical power to the plurality of elongate clothes hanging members 42 on which clothes are placed so as to affect heating or warming of the clothes.

As shown in FIG. 2*a*, the foldable frame is in a collapsed configuration whereby the first arm assembly and the second arm assembly are generally parallel to each other. The foldable frame 40 may be extended as shown in FIG. 2*a* such that the first arm assembly is hinged relative to the second arm assembly to a horizontal state, whilst the spigot portion of the first joint device 10 is maintained in the same rotational relationship. Further, as shown in FIG. 2*c*, the second arm assembly may also be hinged relative to the first arm assembly whilst the spigot portion 12 of the joint device 10 is again maintained in the same rotational relationship.

As will be appreciated by those skilled in the art, it is necessary that the power cables 20 and 20*a* do not interfere with each other and are not exposed to fatigue which may ultimately rupture the cables and for safety concerns and potentially electrician to a user. The present invention provides a joint device 10 which allows the hinged movement between the two arm assemblies whilst maintaining electrical installation and integrity of the electrical cables 20, 20*a* which provide power to heating elements which are disposed at or adjacent the elongate clothes hanging members 42. The joint device 10 of the present invention is adapted to allow for multiple independent movements by the arm assemblies without the integrity of the electric cables being compromised. Thus, an expandable foldable frame for warming clothes may be provided which allows the advantage of rapid disassembly and storage when not in use.

Figure 3A:
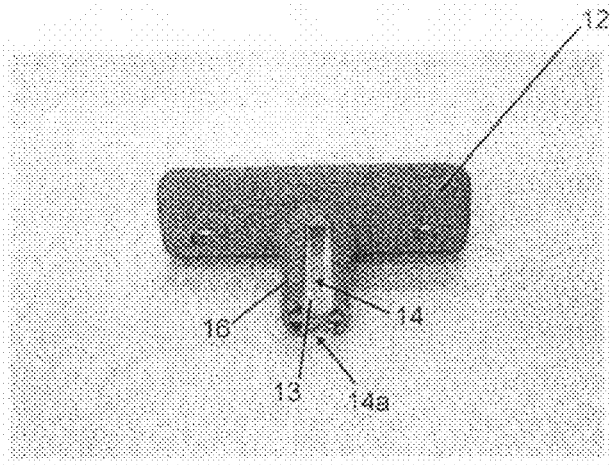
FIG. 3*a* shows a perspective view of a central pivot member of a joint device according to the present invention.
Figure 3B:
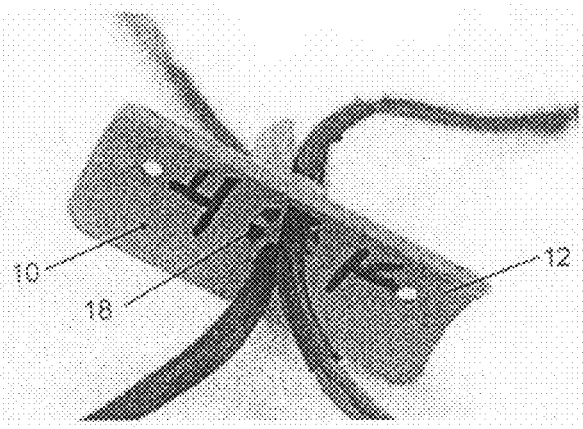
FIG. 3*b* shows a perspective view of the central pivot member as depicted in FIG. 3*a* including a pair of electrical cables.
Figure 3C:
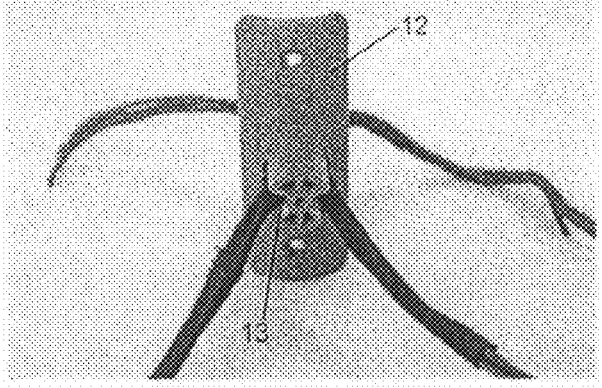
FIG. 3*c* shows a further view of the central pivot member as depicted in FIG. 2*b;*
Figure 3D:
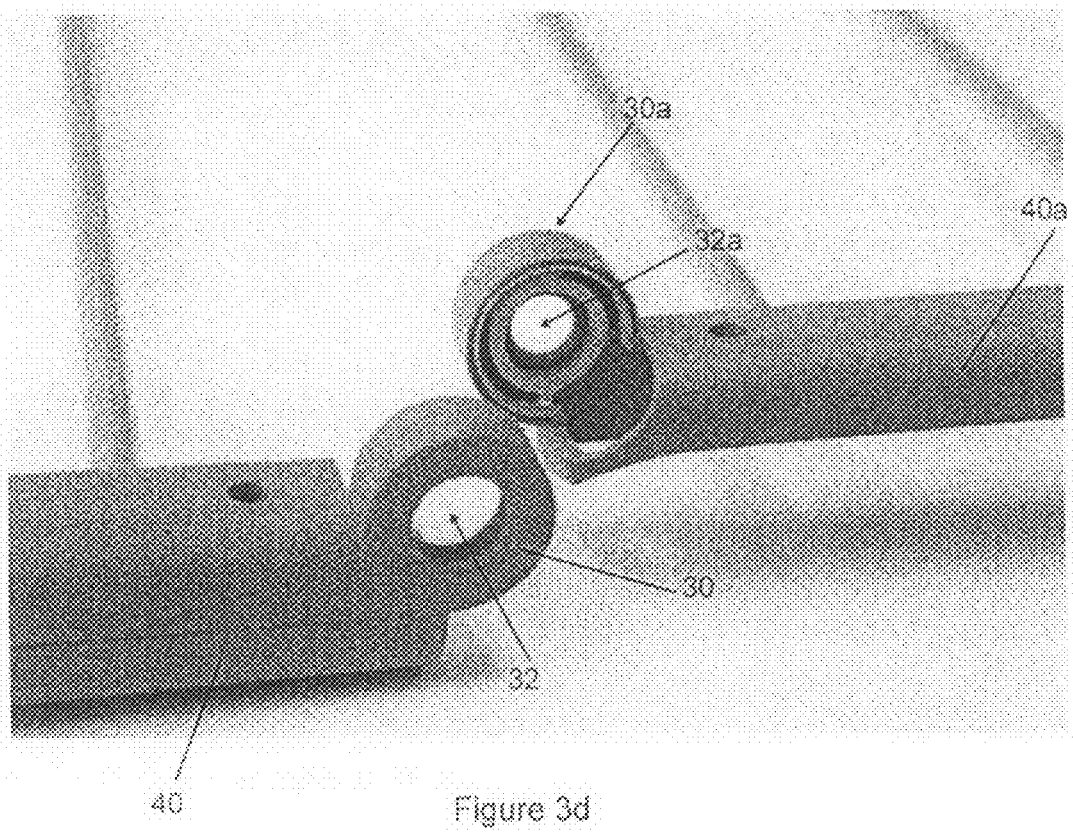
FIG. 3*d* shows a first boss member and a second boss member of a joint device according to the present invention each integrally formed with a first arm member and a second arm member.
Figure 3E:
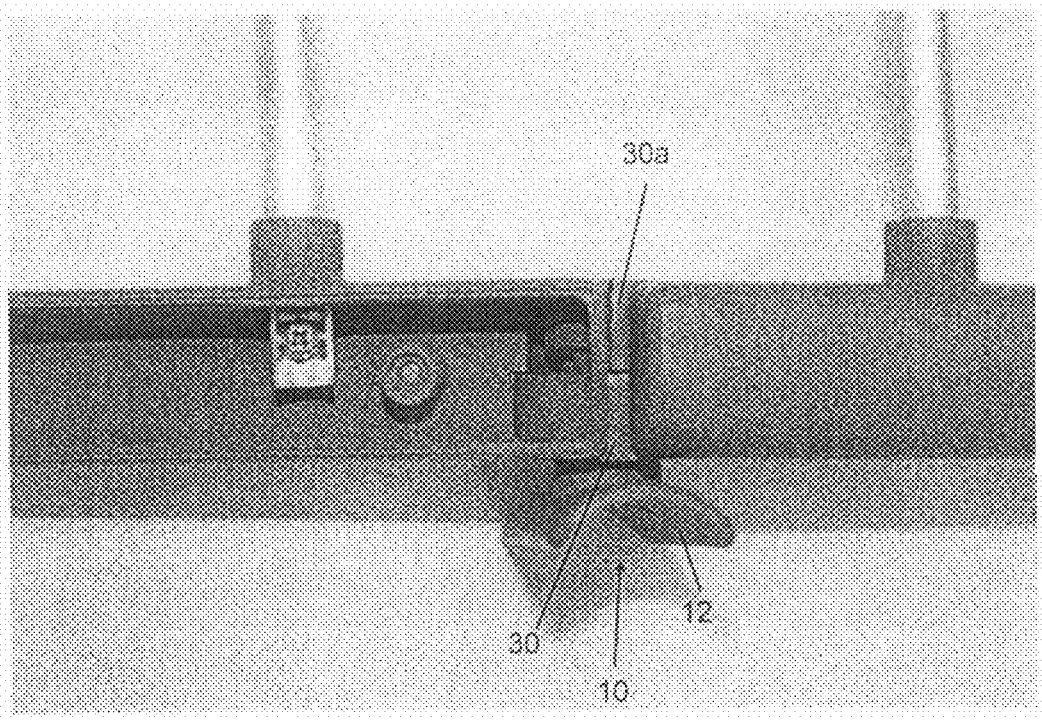
FIG. 3*e* shows the bosses and arm members depicted in FIG. 3*b* engaged with the central pivot member as depicted in FIG. 3*a;*

Referring to FIGS. 3*a*, 3*b* and 3*c*, a detailed view of the central pivot member 12 of the joint device 10 according to the present invention is shown. The central pivot member 10 includes a spigot portion 16 which acts as a pin joint when disposed within the passages 32, 32*a* of the first and second boss members 30, 30*a*. As such, the first arm member 40 and the second arm member 40*a* are provided with hinged relative motion, relative to each other. The central pivot member 12 has a central passage 14, 14*a* for receiving electrical power conductors 20, 20*a*, and a separation portion 13 which maintains the first electric conductor 20 and the second electric conductor 20*a* in a spaced part relationship upon relative hinged movement between the first arm member 40 and the second arm member 40*a*.

Figure 3F:
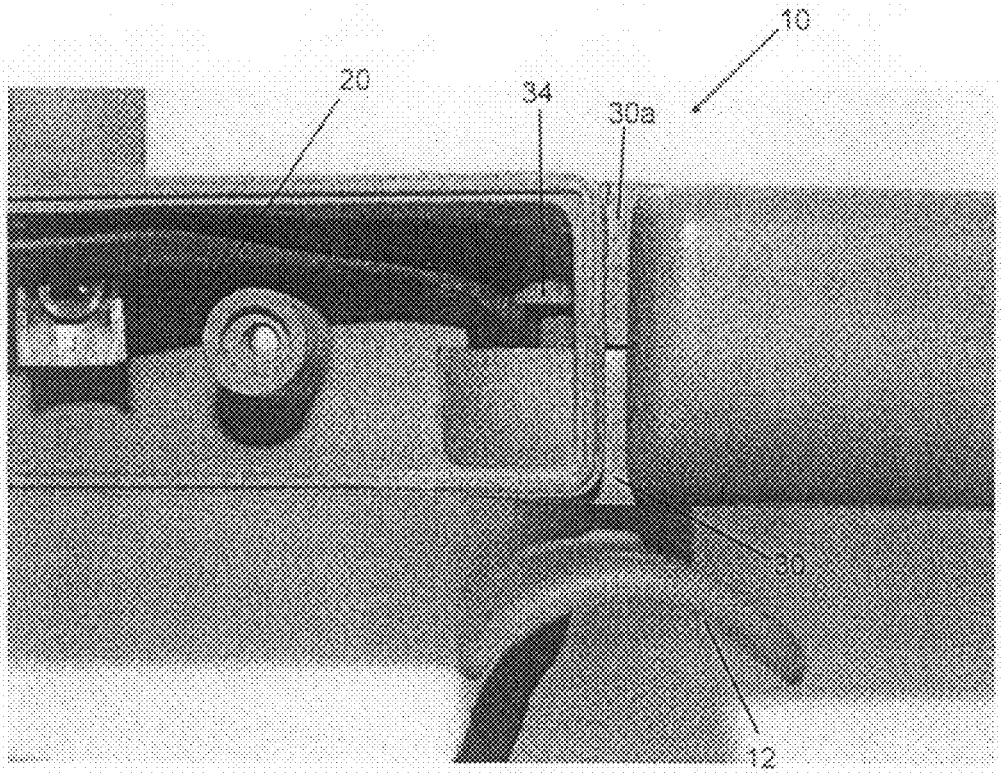
Figure 3G:
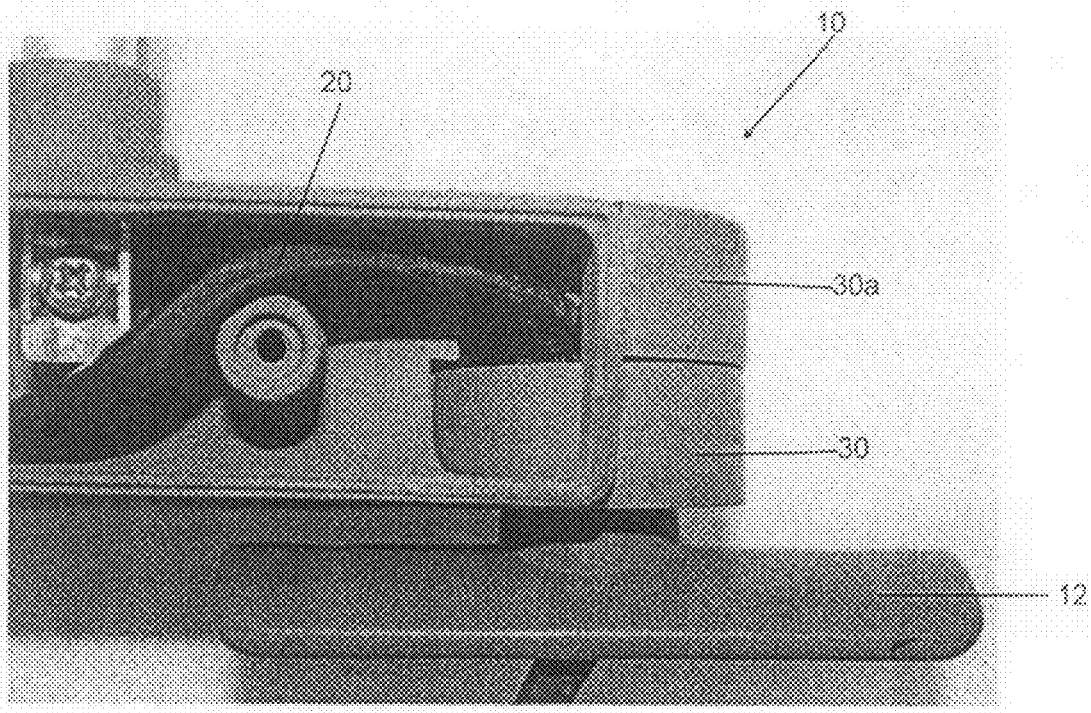
FIG. 3*g* shows the joint device as depicted in FIG. 3*f* in a second configuration.

Referring to FIGS. 3*f* and 3*g*, the first boss member 30 and the second boss member 30*a* each have radially disposed apertures for passage of the first and second electrical conductors 20, 20*a* from the central passage of the central pivot member 12 to the first and second arm members 40, 40*a* respectively. As will be appreciated by those skilled in the art, electrical communication can be provided by the present invention to both the first arm member 40 and the second arm member 40*a* throughout hinged movement of the arm members without interference of the electrical conductors 20, 20*a* with each other and without excessive movement or twisting of the electrical conductors 20, 20*a* so as to provide good endurance and fatigue life of the conductors thus providing a safe manner in which to transfer electrical power ultimately from the conductors to the heating elements disposed in or adjacent the elongate hanging members 42.

Referring to FIGS. 4*a*, 4*b* and 4*c*, there is an exemplary embodiment of a foldable frame assembly 50 for warming clothes according to the present invention. In the present embodiment, the frame assembly 50 includes a foldable frame 40 similar or same as depicted in reference to FIGS. 2*a*, 2*b* and 2*c*, and a support stand for supporting the foldable frame 40. Similarly as described with the erecting and folding process with reference to FIGS. 2*a*, 2*b* and 2*c*, the foldable frame assembly 50 also provides for foldable and storable configuration of the frame when the foldable frame 40 is in a non-erect state. As will be appreciated, this allows for ease of storage of the foldable frame assembly 50 when not in use.

Figure 5C:
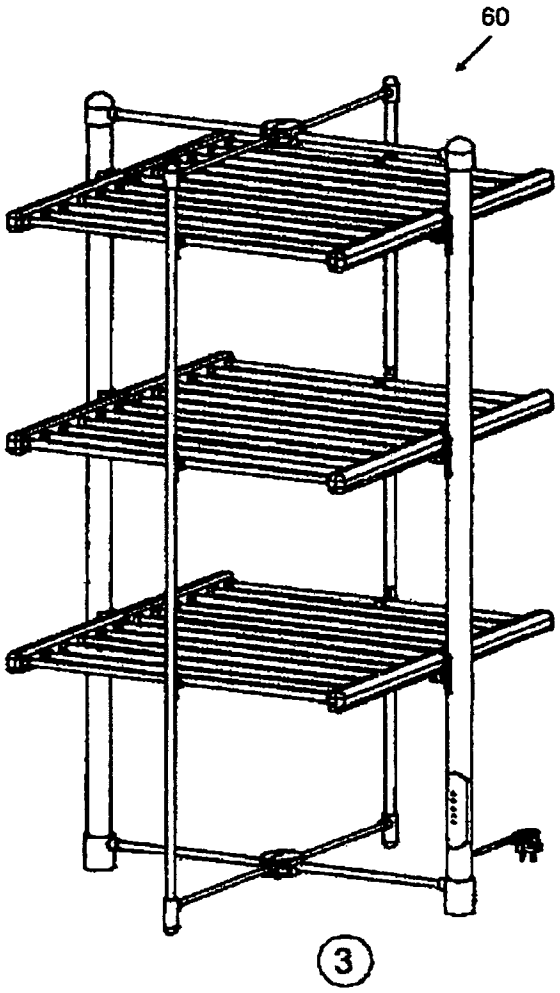
FIG. 5*c* shows the foldable frame assembly as depicted in FIG. 5*a* and FIG. 5*b* in a fully assembled configuration.
Figure 5B:
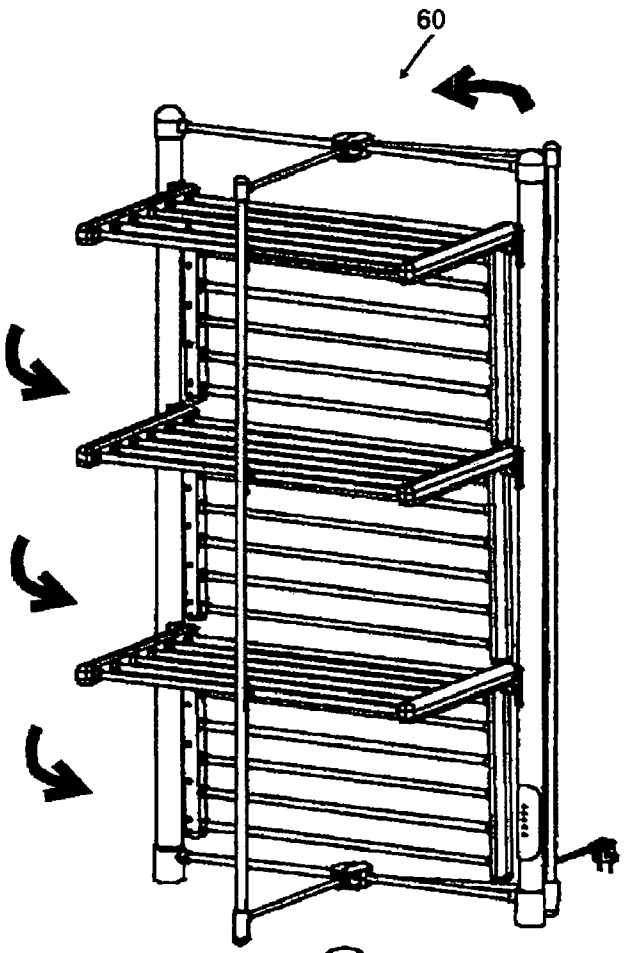
FIG. 5*b* shows the foldable frame assembly as depicted in FIG. 5*a* in partially assembled configuration.
Figure 5A:
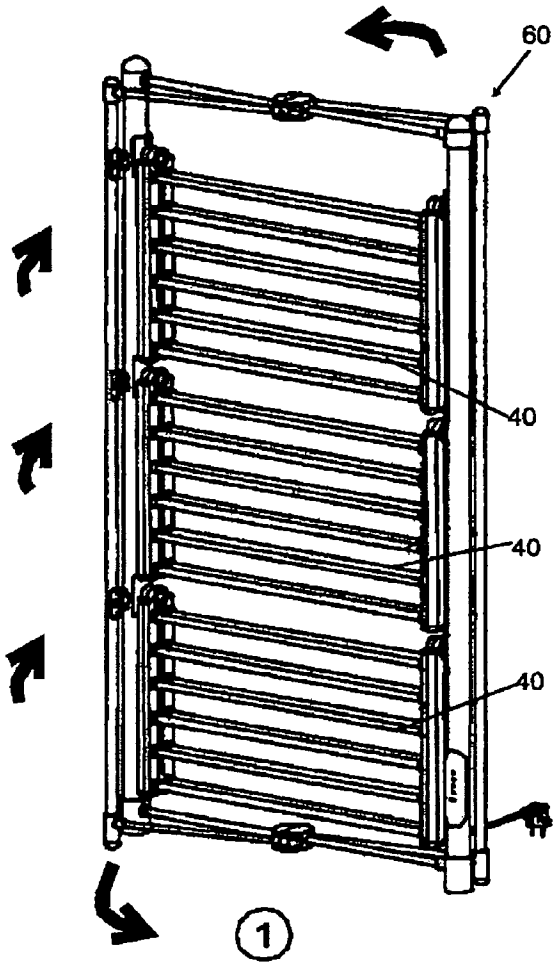
FIG. 5*a* shows a further embodiment of a foldable frame assembly according to the present invention in a closed configuration.

As shown in FIGS. 5*a*, 5*b* and 5*c*, similarly as depicted with reference to FIGS. 4*a*, 4*b* and 4*c*, a foldable frame assembly 60 is shown, however in the present embodiment, three foldable frames 40 are used for providing increased area of warming or heating of clothes. Again, as will be appreciated, the foldable frame assembly 60 is readily disassembled and foldable so as to allow for planet configuration and ease of storage.

Figure 6A:
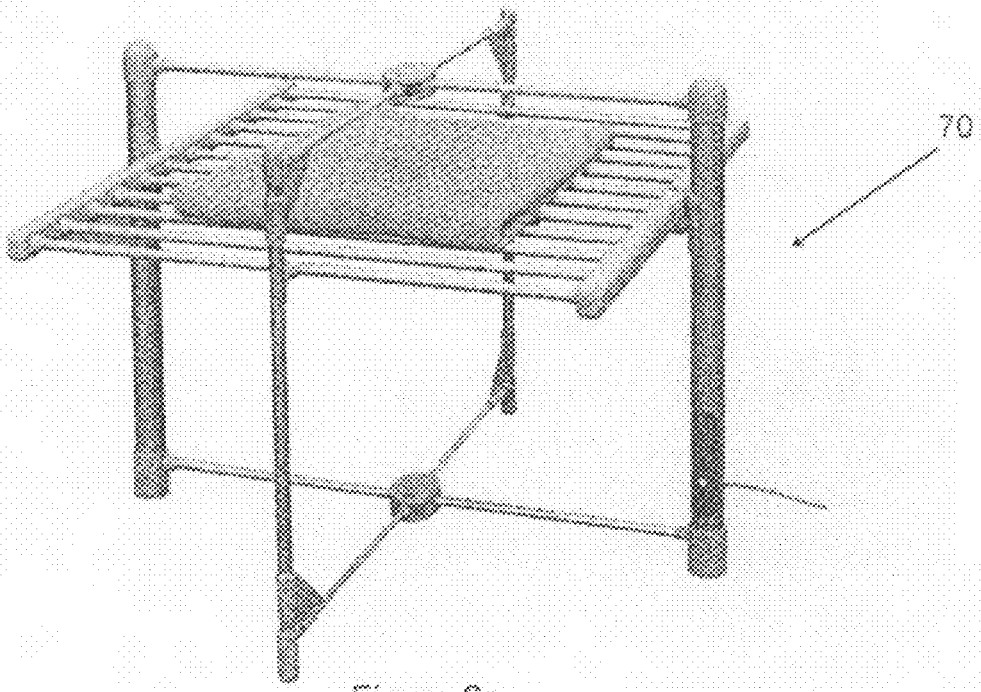
FIG. 6*a* shows an exemplary embodiment of a foldable frame assembly according to the present invention having one foldable frame.
Figure 6B:
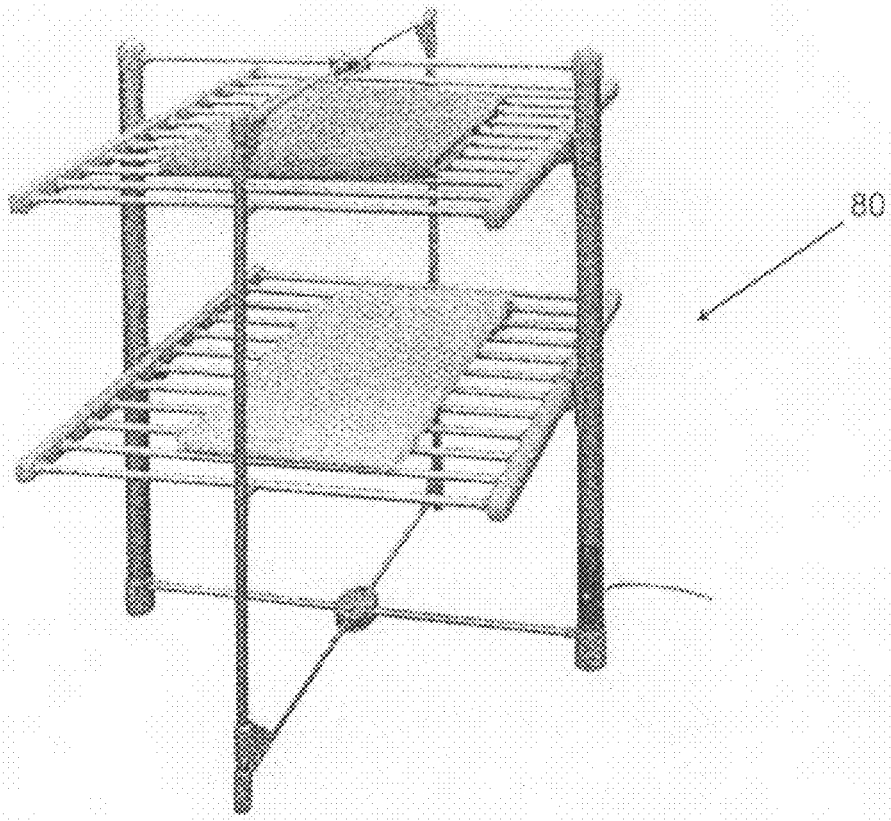
FIG. 6*b* shows another exemplary embodiment of a foldable frame assembly according to the present invention having two foldable frames.
Figure 6C:
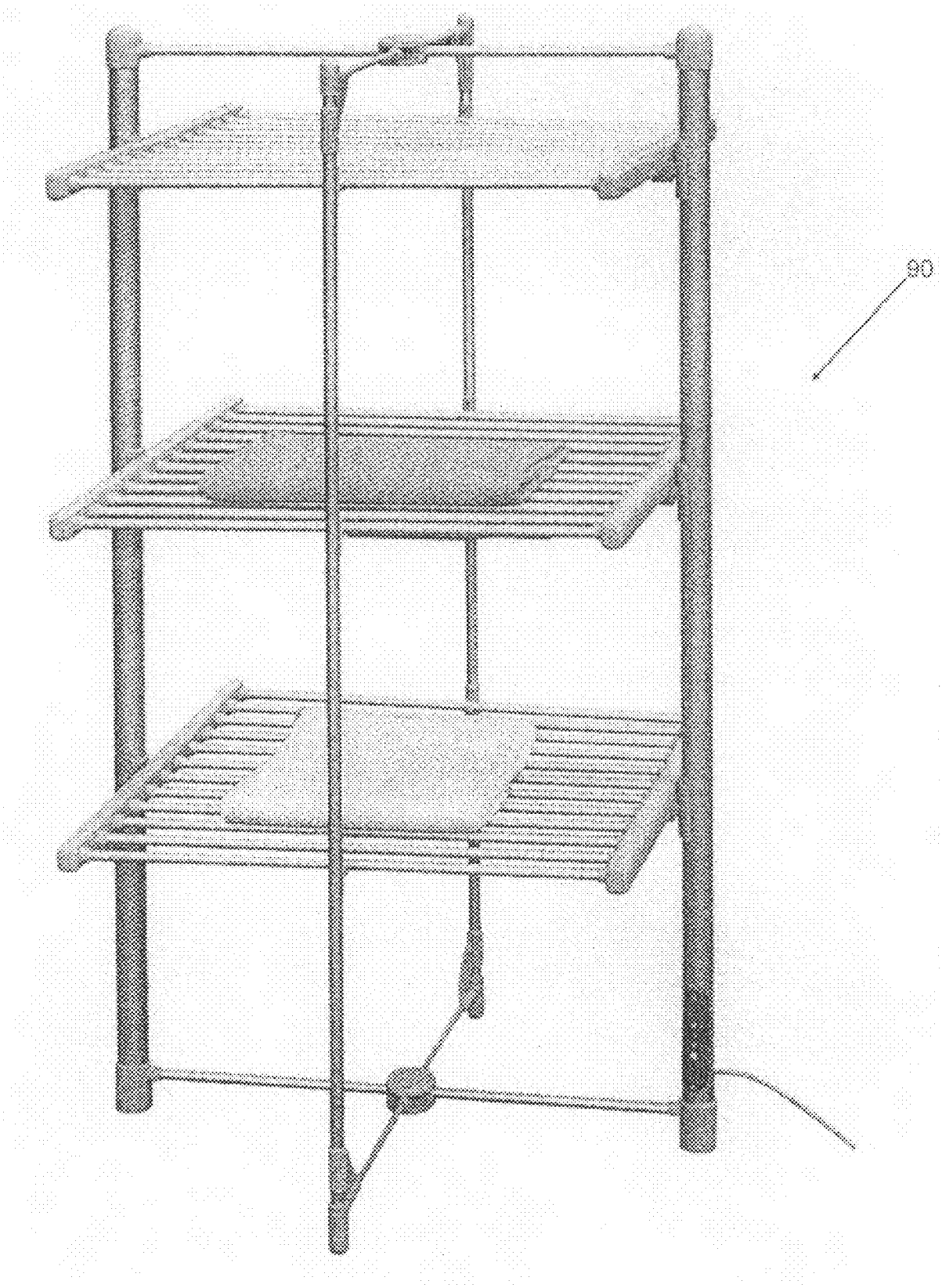
FIG. 6*c* shows a further exemplary embodiment of a foldable frame assembly according to the present invention having three foldable frames.

Now referring to FIGS. 6*a*, 6*b* and 6*c*, exemplary embodiments of foldable frame assemblies 70, 80 and 90 as shown, whereby a one-tier, two-tier and three-tier assembly is implemented respectively. As will be appreciated by those skilled in the art, electrical connection and wiring may be effected within the frame so as to provide power for heating to each of the foldable frames depending on the number provided and the particular configuration. Further, as will also be appreciated by those skilled in the art, by providing a device as depicted and shown in the present invention, heating of clothes may be effected safely and efficiently by a foldable frame assembly which allows ease of storage whilst still maintaining safety to a user due to the joint device as provided by the present invention. Thus, an effective heating or warming frame may be provided without compromising the safety of a user of such a device.

It will be appreciated that the above described embodiments may take alternate forms and include additional features which, when used with the present invention, remain within the scope and spirit of the invention as described and claimed.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A foldable frame for warming of clothes, said frame comprising:

a first arm assembly including a pair generally elongate first arm members being maintained in a parallel spaced apart relationship by a plurality of elongate clothes hanging members extending therebetween;

a second arm assembly including a pair generally elongate second arm members being maintained in a parallel spaced apart relationship by a plurality of elongate clothes hanging members extending therebetween;

a first joint device and a second joint device disposed between adjacent ends of the first and second arm members respectively in a manner so as to provide relative hinged movement between the first arm assembly and the second arm assembly;

wherein at least one joint device comprises a first boss member having a passage extending therethrough, said first boss member being fixed relative to an adjacent first arm member;

a second boss member having a passage extending therethrough, the passage of the first boss member being coaxially aligned with that of the second boss member, said second boss member being fixed relative to an adjacent second arm member;

a central pivot member including a spigot portion adapted to extend at least partly through the central passages of the boss members to allow relative hinged movement between the first arm member and the second arm member;

a central passage for receiving a first electrical conductor for delivery of electrical power to the first arm assembly via the adjacent first arm member for supplying power to a heating element associated with the elongate clothes hanging members, and for receiving a second electrical conductor for delivery of electrical power to the second arm assembly via the adjacent second arm member for supplying power to a heating element associated with the second arm member; and a separation portion for maintaining the first electrical conductor and the second electrical conductor in a spaced apart relationship upon relative hinged movement between the first arm member and the second arm member.

2. The foldable frame according to claims 1, wherein the first arm assembly and the second arm assembly are independently moveable relative to each other from a non-erect configuration whereby the arm assemblies extend from the joint devices in a downward direct to an erect configuration whereby the arm assemblies extend in generally horizontal plane.

3. The foldable frame according to claim 1, wherein the joint devices each include a mounting portion for engagement with a support stand.

4. The foldable frame according to claim 3, wherein the central passage of the at least one joint device extends through its mounting portion.

5. The foldable frame according to claim 1, wherein the first boss member and the second boss member of the at least one joint device have generally circular passages and the spigot portion of central spigot member is generally circular in shape.

6. The foldable frame according to claim 1, wherein the first boss member and the second boss member of the at least one joint device each have radially disposed apertures therein for passage of the first and second electrical conductors to the first and second arm members respectively.

7. The foldable frame according to claim 1, wherein the separating portion of the central pivot member of the at least one joint device is provided as a web formation extending at least partly axially in the central passage.

8. The foldable frame according to claim 1, wherein the first boss member, the second boss member and the central pivot member of the at least one joint device are from a material having electrical insulating properties.

9. The foldable frame according to claim 1, wherein the first boss member, the second boss member and the central pivot member of the at least one joint device are formed from a polymeric material.

10. A foldable frame assembly for warming of clothes, said assembly comprising:

at least one foldable frame according to claim 1; and a support stand for supporting said at least one foldable frame at the first joint member and the second joint member to allow independent movement of the first arm assembly and the second arm assembly.

11. The foldable frame assembly according to claim 10, wherein the frame assembly comprises:

a first pair of vertical support members each being disposed in a vertical orientation and engaged with the first and second joint members;

an upper bracing member and a lower bracing member each extending generally horizontally above and below the at least one foldable frame respectively and between the first pair of vertical support members;

a second pair of vertical support members each being disposed in a vertical orientation between the first pair of vertical support members and spaced apart so as to allow free relative hinged movement between the first arm assembly and the second arm assembly from a lowered position to an erect horizontal position; and upper and lower tie members extending from the upper and lower ends of the second pair of vertical support members and hingedly engaged with the upper and lower bracing members respectively so as to allow the second pair of vertical support members to be moved adjacent the first pair of vertical support members when the at least one foldable frame is a the lowered position.

12. The foldable frame assembly according to claim 11, further comprising a detachably engageable engagement mechanism for engaging the first and second arm assemblies with the second pair of vertical support members.

13. The foldable frame assembly according to claim 11, wherein the first electrical conductor and the second electrical conductor extend through at least one of the support members first pair of vertical support members.

* * * * *